US005517920A

United States Patent [19]

Hinz et al.

[11] Patent Number: 5,517,920

[45] Date of Patent: May 21, 1996

[54] DEVICE FOR SEQUENTIALLY FIRING ELECTRICAL DETONATORS

[75] Inventors: Clemens Hinz, Marl-Sinsen; Martin Streich, Fröndenberg, both of Germany

[73] Assignee: Bergwerksverband GmbH, Essen, Germany

[21] Appl. No.: 367,121

[22] PCT Filed: Jul. 23, 1993

[86] PCT No.: PCT/EP93/01962

§ 371 Date: Mar. 2, 1995

§ 102(e) Date: Mar. 2, 1995

[87] PCT Pub. No.: WO94/03771

PCT Pub. Date: Feb. 17, 1994

[30] Foreign Application Priority Data

Jul. 31, 1992 [DE] Germany ..... 42 25 330.6

[51] Int. Cl.[6] ..... F23Q 21/00; F42B 3/18

[52] U.S. Cl. ..... 102/215; 102/202.4; 102/217; 361/248

[58] Field of Search ..... 102/206, 217, 102/215, 202.1, 202.2, 202.3, 202.4; 361/248, 249, 250

[56] References Cited

U.S. PATENT DOCUMENTS

| | | | |
|---|---|---|---|
| 3,675,578 | 7/1972 | Douglas et al. | 361/248 |
| 3,700,971 | 10/1972 | Everest et al. | 361/250 |
| 4,099,467 | 7/1978 | Mackellar et al. | 102/217 |
| 4,489,655 | 12/1984 | Molnar | 102/217 |
| 4,527,636 | 7/1985 | Berdon | 102/217 |
| 4,610,203 | 9/1986 | Bock | 102/217 |
| 4,646,640 | 3/1987 | Florin et al. | 361/248 |
| 4,769,734 | 9/1988 | Heinemeyer et al. | 102/202.4 |
| 4,796,531 | 1/1989 | Smithies et al. | 102/217 |
| 4,848,232 | 7/1989 | Kurokawa et al. | 102/200 |

*Primary Examiner*—Charles T. Jordan
*Assistant Examiner*—Theresa M. Wesson
*Attorney, Agent, or Firm*—John W. Carpenter

[57] ABSTRACT

The invention concerns a device for the sequential firing of electrical detonators in several firing circuits, the device consisting of a detonating machine, electric leads and switches for activating the firing circuits. The detonating machine (1) is connected by a lead (2) to an electronic firing switch (3) to which are connected the firing circuits (13*a* . . . 13*n*) which consist of one or more series-connected electrical detonators (14*a* . . . 14*n*) and explosive charges (4*a* . . . 4*n*) designed to be detonated by the detonators, the electronic firing switch (3) consisting of a firing-current detection circuit (7), a logic circuit (8), switching relays (10*a* . . . 10*n*), a power supply (9) and protective resistors (11*a* . . . 11*n*).

8 Claims, 1 Drawing Sheet

DEVICE FOR SEQUENTIALLY FIRING ELECTRICAL DETONATORS

Figure 1:
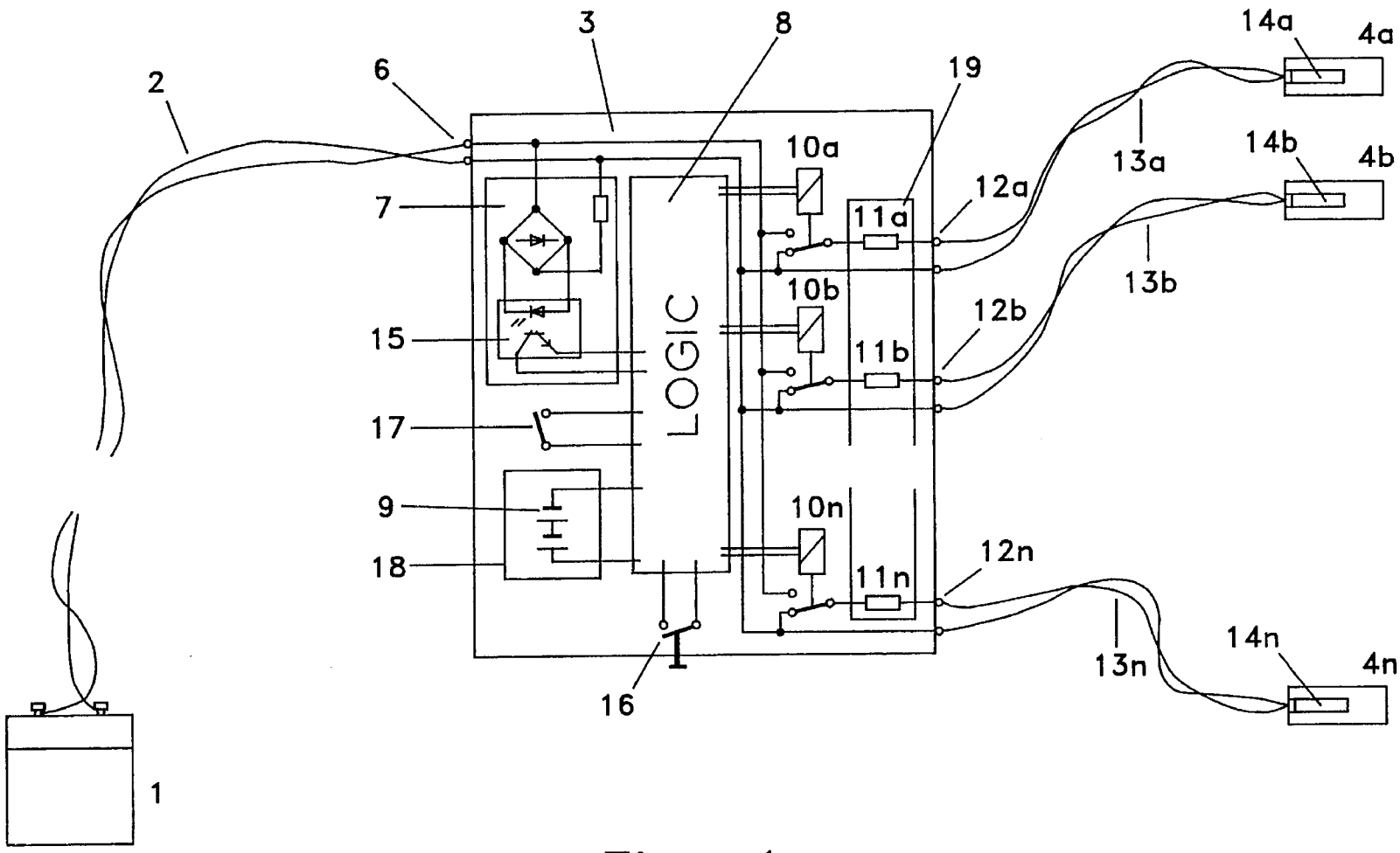

The invention concerns a device for the sequential firing of electrical detonators in several firing circuits, the device consisting of a detonating machine, electric leads and switches for activating the firing circuits. The detonating machine (1) is connected by a lead (2) to an electronic firing switch (3) to which are connected the firing circuits (13*a* . . . 13*n*) which consist of one or more series-connected electrical detonators (14*a* . . . 14*n*) and explosive charges (4*a* . . . 4*n*) designed to be detonated by the detonators, the electronic firing switch (3) consisting of a firing-current detection circuit (7), a logic circuit (8), switching relays (10*a* . . . 10*n*), a power supply (9) and protective resistors (11*a* . . . 11*n*).

DEVICE FOR SEQUENTIALLY FIRING ELECTRICAL DETONATORS

The discovery concerns a device for the sequential firing of electrical detonators in several detonator circuits which are respectively assigned to a detonation circuit, consisting of a detonating machine, of electrical leads and switches for the activation of the detonation circuits.

Such a device is known from U.S. Pat. No. 4,489,655. The disadvantage with this arrangement is that for each charge detonation circuit an individual detonator switch is required which is activated pyrotechnically and is suitable only for one-time use. Further disadvantageously is that with the applied multi-wire technology, a high lead expenditure must be employed which further increases the expense of this arrangement. Finally, for the sequential firing of the individual detonators, an additional selective switch is required on a mechanical basis in order to alternatingly employ the two current conducting leads used.

Additional arrangements for the sequential firing of electrical detonators are known from EP 0 251 824 B1, EP 0 147 688 A2, EP 0 136 919 A2 and GB 21 32 041 A. For these devices, the cost of lead material and switching devices is relatively high.

The task underlying the present invention is to further develop the type of device for the sequential firing of electrical detonators such that the cost of lead material and mechanical switching devices is significantly reduced.

With the device according to invention only a two-wire electrical lead between the detonating machine and the electronic detonating switch is necessary, to which the individual charge detonation circuits are connected.

Expensive mechanical switching devices for alternately switching using a three-wire electrical lead are likewise avoided as are the assigning of mechanical switches to each individual detonation circuit.

Through the electronic detonation switch it is ensured that the predetermined detonation sequence is reliably complied with. Besides this, it is guaranteed that no unintentional triggering of a detonator can take place as a detonation pulse can be relayed further only to previously cleared detonation circuits.

Unintentional detonations through power supplied to the electronic detonation switch are ruled out as the lower power supply voltage in connection with the protective resistors result in a maximal current strength which lies far beneath the current strength necessary for the firing of a detonator.

The invention is more closely explained in the following using the FIGURE. The single FIGURE shows a basic sketch of a device according to invention.

In the application example of the FIGURE is depicted a detonating machine 1 which is connected to a firing switch 3 via a two-wire electrical lead 2 . The firing switch 3 is assigned via several firing circuits 13*a* . . . 13*n* with one (or several) electrical detonators 14*a* . . . 14*n* to which explosive charges 4*a* . . . 4*n* are assigned which are detonated in a pre-given order and in selectable time intervals. The structure of the firing switch 3 is as follows: Via an input connection 6, both wires of lead 2 are electrically connected with firing switch 3. The single components of firing switch 3 are a firing current detection circuit 7, a logic circuit 8 connected with firing current detection circuit 7, a battery 9 and several switching relays 10*a* . . . 10*n*, to which one pole of lead 2 is connected. Connected following switching relays 10*a* . . . 10*n* are protective resistors 11*a* . . . 11*n*. The firing current detection switch 3 is connected with the individual firing circuits 13*a* . . . 13*n* via the exiting output connections 12*a* . . . 12*n*. As shown in FIG. 1, the battery 9 is housed in receptacle 18, and the protective resistors are housed in receptacle 19.

The logic circuit 8 of firing switch 3 can be set into its original position by a reset switch 16. By means of logic switch 8 it is guaranteed during execution of blastings that progression to the respective next firing circuit does not take place with an interruption of the firing circuits 13*a* . . . 13*n*. Following elimination of the malfunction, the blasting process can be continued according to plan. The opening of an interrupted firing circuit 13*a* . . . 13*n* can be recognized via the firing current detection circuit 7 and registered to logic circuit 8. Via a function selector 17, logic circuit 8 however also can be set such that further switching following each firing impulse is undertaken, even if the exploding of a detonator is not achieved.

EXAMPLE

The example circuit recorded in the basic circuit diagram of the FIGURE was checked in tests.

Not only optocoupler 15, for recognition of the firing current, but also the circuit contacts of the switching relays exhibit a high effective electric strength of 4000 volts such that no destructive voltage sparkovers into the electronics from the firing voltage, which amounts to 700 volts, occurs.

To rule out that defective electronics can fire a charge, a sufficiently low operational voltage of 3 volts was selected which, together with the protective resistances 11*a* . . . 11*n* set at 60 ohms emit a maximal error voltage of 50 milliamperes, which surely actuates no detonator as the detonators used in Germany exhibit a guaranteed non-actuation voltage strength of 0.45 A.

In switching experiments, an acceptable actuation of the next respective detonator 14*a* . . . 14*n* is reached. Despite the high voltages of the detonation machine (up to 1000 volts) and the high detonation current (about 20 amperes), the comparatively small switching relays 10*a* . . . 10*n* functioned without objection, as switching took place only without load and loading was respectively only for quite a short time (ca. 3 ms).

| Reference Number List | |
|---|---|
| 1 | Detonating Machine |
| 2 | Lead |
| 2a,b | Wires |
| 3 | Electrical Firing Switch |
| 4a..n | Blasting Charge |

-continued

| Reference Number List | |
|---|---|
| 6 | Input Connection |
| 7 | Firing-Current Detection Circuit |
| 8 | Logic Circuit |
| 9 | Battery (mechanically encased) |
| 10a...n | Switching Relay |
| 11a...n | Protective Resistor |
| 12a...n | Output Connection |
| 13a...n | Firing Circuit Lead |
| 14a...n | Electrical Detonators |
| 15 | Optocouplers |
| 16 | Reset Circuit |
| 17 | Function Selector |
| 18 | Receptacle Part |
| 19 | Receptacle Part |

We claim:

1. An electronic firing switch (3) for the sequential detonation of electrical detonators consisting of a voltage source, electrical leads and switches for the activation of detonation circuits characterized thereby in that a detonating machine (1) is connected via a lead (2) with said electronic firing switch (3) to which is connected at least one firing circuit (13*a*), said electronic firing switch (3) comprising at least one firing circuit (13*a*) in electrical communication with said electronic firing switch (3), at least one electrical detonator (14*a*) in electrical communication with said least one firing circuit (13*a*) so as to be wired in series and through at least one detonatable explosive charge (4*a*), and the electronic firing switch (3) additionally comprising a firing-current detection circuit (7), a logic circuit (8), at least one switching relay (10*a*), a current source (9) and at least one protective resistance (11*a*).

2. The electronic firing switch according to claim 1 characterized thereby in that a low voltage battery (9) serves as the voltage source of said firing switch (3), and said least one protective resistance (11*a*) is provided for limiting an emergent fault current to a maximum value of ⅓ of the non-actuation current of said least one electrical detonator (14*a*).

3. The electronic firing switch (3) of claim 1 characterized thereby in that in order to exclude a sparkover of said least one protective resistance (11*a*) in case of a fault, said battery (9) and said least one protective resistance (11*a*) are housed separately from one another in a battery receptacle (18) and a resistor receptacle (19), respectively.

4. The electronic firing switch (3) of claim 2 characterized thereby in that in order to exclude a sparkover of said least one protective resistance (11*a*) in case of a fault, said battery (9) and said least one protective resistance (11*a*) are housed separately from one another in a battery receptacle (18) and a resistor receptacle (19), respectively.

5. An electronic firing switch (3) for the sequential detonation of electrical detonators consisting of a voltage source, electrical leads and switches for the activation of detonation circuits characterized thereby in that a detonating machine (1) is connected via a lead (2) with said electronic firing switch (3) to which are connected a plurality of firing circuits (13*a* . . . 13*n*), said electronic firing switch (3) comprising a plurality of firing circuits (13*a* . . . 13*n*) in electrical communication with said electronic firing switch (3), a corresponding plurality of electrical detonators (14*a* . . . 14*n*) in electrical communication with said plurality of firing circuits (13*a* . . . 13*n*) so as to be wired in series and through a corresponding plurality of detonatable explosive charges (4*a* . . . 4*n*), and the electronic firing switch (3) additionally comprising a firing-current detection circuit (7), a logic circuit (8), a plurality of switching relays (10*a* . . . 10*n*) corresponding to said plurality of firing circuits (13*a* . . . 13*n*), a current source (9) and a plurality of protective resistances (11*a* . . . 11*n*) corresponding to said plurality of firing circuits (13*a* . . . 13*n*).

6. The electronic firing switch according to claim 5 characterized thereby in that a low voltage battery (9) serves as the voltage source of said firing switch (3), and said plurality of protective resistances (11*a* . . . 11*n*) is provided for limiting an emergent fault current to a maximum value of ⅓ of the non-actuation current of said plurality of electrical detonators (14*a* . . . 14*n*).

7. The electronic firing switch (3) of claim 5, characterized thereby in that in order to exclude a sparkover of any of said plurality of protective resistances (11*a* . . . 11*n*) in case of a fault, said battery (9) and said plurality of protective resistances (11*a* . . . 11*n*) are housed separately from one another in a battery receptacle (18) and a resistor receptacle (19), respectively.

8. The electronic firing switch (3) of claim 6 characterized thereby in that in order to exclude a sparkover of any of said plurality of protective resistances (11*a* . . . 11*n*) in case of a fault, said battery (9) and said plurality of protective resistances (11*a* . . . 11*n*) are housed separately from one another in a battery receptacle (18) and a resistor receptacle (19), respectively.

* * * * *